US012082680B2

(12) United States Patent
Crapet

(10) Patent No.: US 12,082,680 B2
(45) Date of Patent: Sep. 10, 2024

(54) APPLICATOR FOR COSMETIC PRODUCT, IN PARTICULAR MASCARA, ASSOCIATED APPLICATOR ASSEMBLY AND METHOD FOR MANUFACTURING SUCH AN APPLICATOR

(71) Applicant: ALBEA SERVICES, Gennevilliers (FR)

(72) Inventor: Yann Crapet, Gennevilliers (FR)

(73) Assignee: ALBEA SERVICES, Gennevilliers (FR)

( * ) Notice: Subject to any disclaimer, the term of this patent is extended or adjusted under 35 U.S.C. 154(b) by 260 days.

(21) Appl. No.: 17/618,494

(22) PCT Filed: Aug. 20, 2020

(86) PCT No.: PCT/EP2020/073418

§ 371 (c)(1),
(2) Date: Dec. 12, 2021

(87) PCT Pub. No.: WO2021/058210

PCT Pub. Date: Apr. 1, 2021

(65) Prior Publication Data

US 2023/0172341 A1 Jun. 8, 2023

(30) Foreign Application Priority Data

Sep. 27, 2019 (FR) ..... 1910744

(51) Int. Cl.
*A45D 40/26* (2006.01)

(52) U.S. Cl.
CPC ..... *A45D 40/265* (2013.01)

(58) Field of Classification Search
CPC .... A45D 34/04; A45D 34/041; A45D 34/045; A45D 40/261; A45D 40/265; A45D 40/28; A45D 2040/0012; A46B 9/021; A46B 2200/1053
See application file for complete search history.

(56) References Cited

U.S. PATENT DOCUMENTS

| | | | | |
|---|---|---|---|---|
| 4,446,880 | A * | 5/1984 | Gueret | A45D 40/265 132/218 |
| 7,467,905 | B2 * | 12/2008 | Habatjou | A46B 9/021 401/126 |
| 7,914,221 | B2 * | 3/2011 | Milesi | A46B 9/021 401/126 |
| 2008/0219748 | A1 * | 9/2008 | Salciarini | A46D 1/08 401/129 |
| 2013/0319451 | A1 * | 12/2013 | Viegas | A45D 40/262 132/218 |
| 2014/0246043 | A1 | 9/2014 | Befve et al. | |
| 2017/0071315 | A1 | 3/2017 | Pires | |

(Continued)

*Primary Examiner* — Rachel R Steitz
(74) *Attorney, Agent, or Firm* — Kilpatrick Townsend & Stockton LLP

(57) ABSTRACT

The invention relates to an applicator (1) for a cosmetic product, comprising: —a core (2) extending in a direction of longitudinal extension (X), referred to as the main direction, —at least one movable element (5) extending along all or part of a length of the core (2) from a first end (5*a*) attached to the core (2) to a second end (5*b*) that is freely movable in relation to the core (2), the core (2) and/or the at least one movable element (5) comprising a plurality of protruding projections (7.1, 7.2).

10 Claims, 4 Drawing Sheets

(56) References Cited

U.S. PATENT DOCUMENTS

2017/0360185 A1* 12/2017 De Bardonneche ..... A45D 40/265

2019/0298049 A1 10/2019 Castex

* cited by examiner

[Fig. 1]
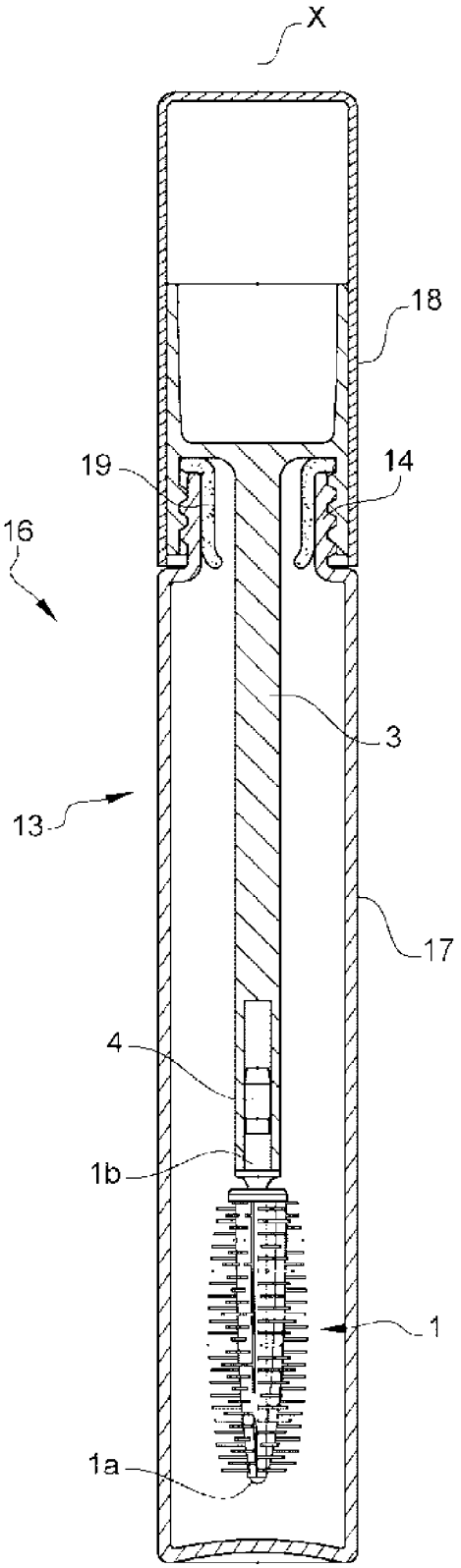

[Fig. 2]
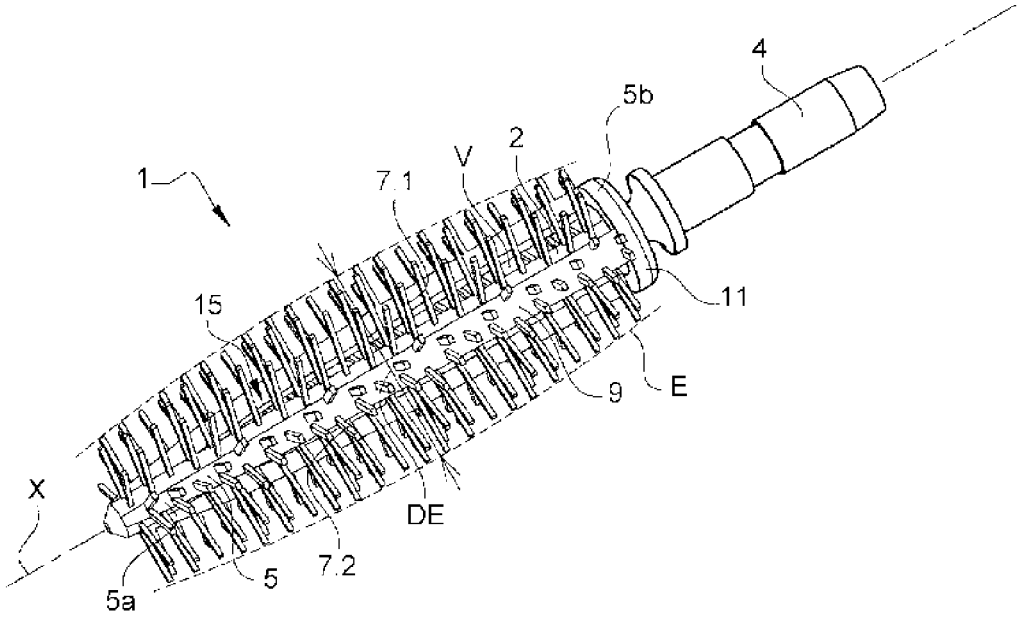
[Fig. 3]
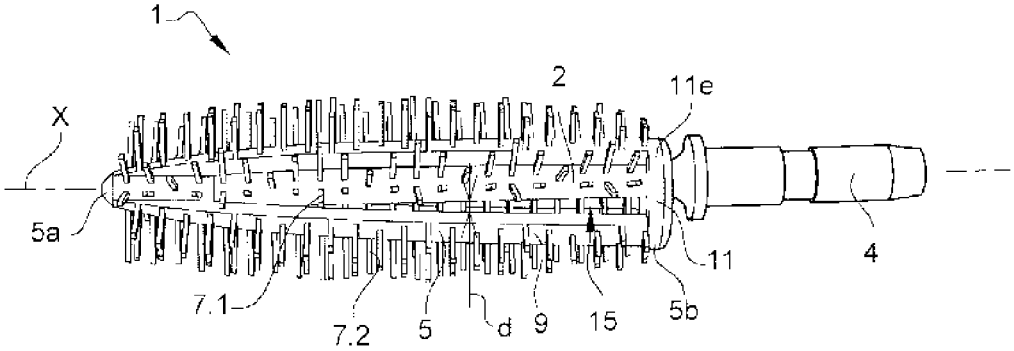

[Fig. 4]
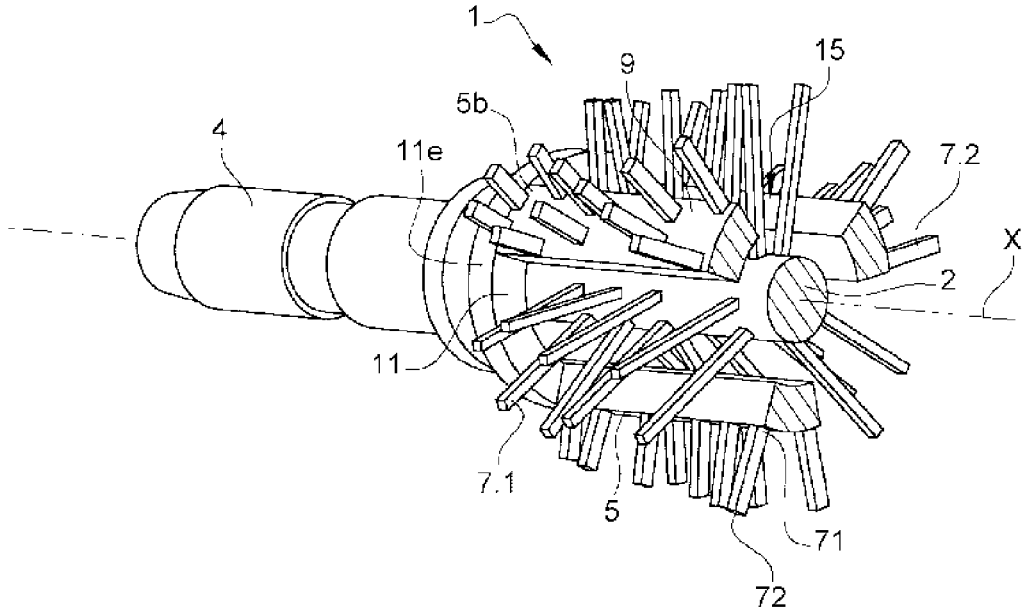
[Fig. 5]
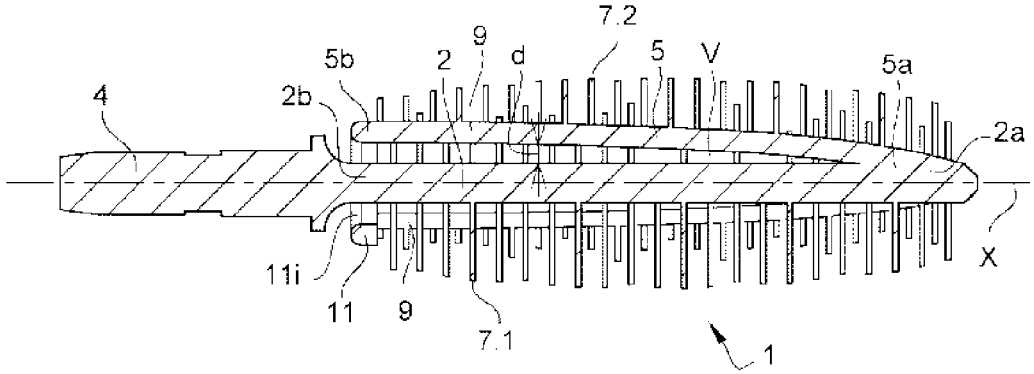

[Fig. 6]
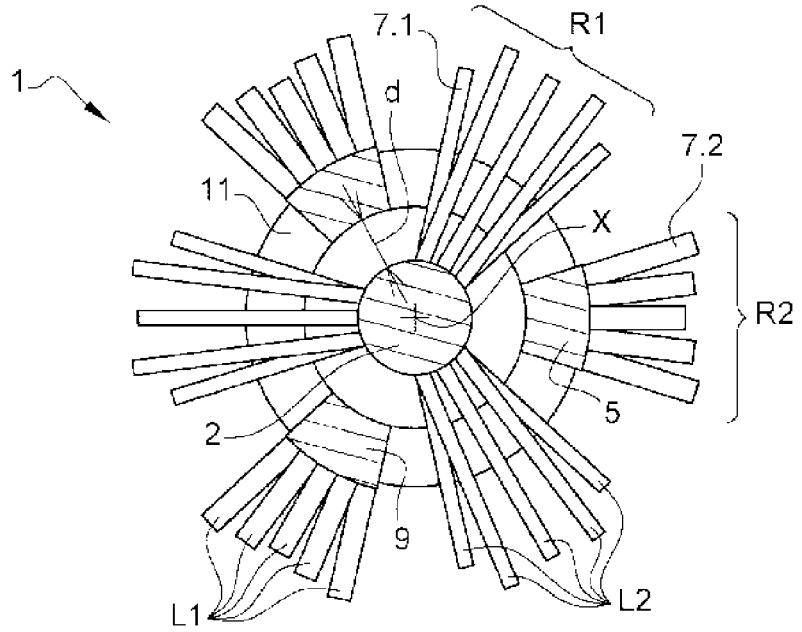
[Fig. 7]
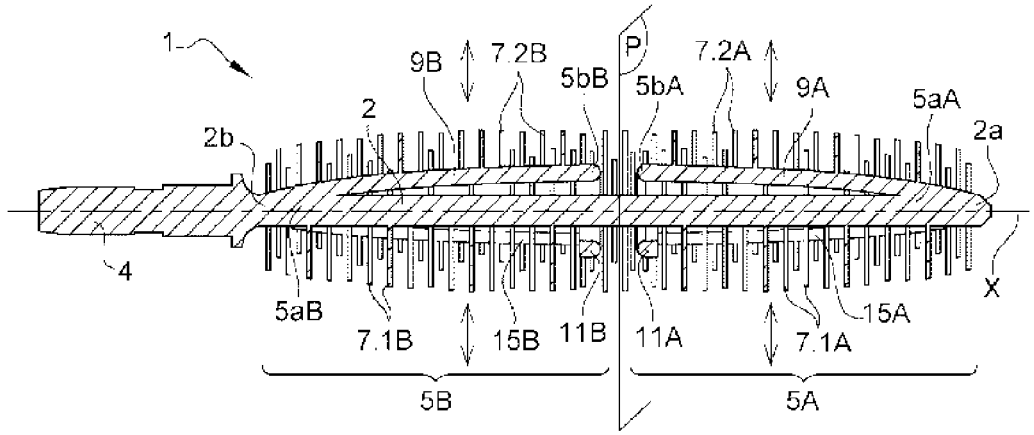

APPLICATOR FOR COSMETIC PRODUCT, IN PARTICULAR MASCARA, ASSOCIATED APPLICATOR ASSEMBLY AND METHOD FOR MANUFACTURING SUCH AN APPLICATOR

CROSS-REFERENCE TO RELATED APPLICATIONS

This application is a § 371 national phase entry of International Application No. PCT/EP2020/073418, filed Aug. 20, 2020, which claims priority to French Patent Application No. 1910744, filed Sep. 27, 2019.

TECHNICAL FIELD OF THE INVENTION

The invention relates to an applicator for cosmetic product, in particular mascara, and an associated applicator assembly. The invention further relates to a method for producing such an applicator.

BACKGROUND

The mascara applicators can be obtained from fibrous elements held between the longitudinal parts of a twisted metal broach; they are then commonly called "twisted brushes". The ends of the fibrous elements usually form envelopes along a longitudinal extension direction of the brush. The twisted brushes have, by their producing mode, an envelope with cylindrical shape that offers few possibilities in terms of make-up effects. Many solutions have already been proposed to give twisted brushes various shapes.

The mascara applicators can also be obtained by injection molding of plastic material, they are then commonly called "plastic brushes". Thus, the plastic brushes can have original shapes in order to offer particular make-up effects.

However, there is still a need for improvement of the mascara applicators, in particular to obtain applicators ensuring a sufficient load of cosmetic product and a good restitution of the latter, while preserving a flexibility of application of the cosmetic product.

SUMMARY OF THE INVENTION

The invention relates to an applicator for cosmetic product, comprising:

- a core extending in a direction of longitudinal extension, called principal direction,
- at least one movable element extending along all or part of a length of the core from a first end attached to the core towards a second end that is free to move in relation to the core.

Said core and/or the at least one movable element comprise a plurality of projecting protrusions.

In contrast to the applicators comprising elements whose two ends are attached to the core, for which a pressure on these elements leads to an elastic deformation, for example in the form of an M with a central pinch and a non-uniform distribution of the cosmetic product along the core, in such an applicator, a pressure on the movable element leads to a movement of the latter with respect to the core, which leads to a distribution of the cosmetic product along the entire length of the core.

This improvement in the distribution of the cosmetic product allows a better loading of the cosmetic product and the lashes can be enveloped with a maximum of cosmetic product, which increases the volume effect, in particular depending on the pressure exerted. It is thus possible to reduce the length of the protrusions to improve the combing of the lashes.

Furthermore, the use of an element extending along all or part of a length of the core allows the use of a core with a smaller cross-sectional dimension than that of a conventional applicator. This allows for a more flexible applicator. Similarly, the movement of one end of the movable element relative to the core also allows to provide flexibility to the applicator.

According to various embodiments, which may be taken together or separately:

- the at least one movable element extends around the core,
- the first end is attached at the level of a distal end of the core,
- the first end is attached at the level of a proximal end of the core,
- the proximal end of the core is adapted to be attached to an applicator rod by a sleeve extending the core,
- the second end of the movable element is free to move relative to the sleeve,
- the second end of the movable element is free to move relative to the applicator rod,
- the end that is free to move of the movable element does not form the sleeve of the applicator,
- the second end of the movable element is free to move relative to the core when the applicator is attached to the rod,
- the at least one movable element comprises a wall having at least one opening through which protrusions of the core project,
- the wall is deformable,
- the opening has an elongated shape in the direction of extension of the core,
- the at least one movable element comprises branches extending along the direction of extension of the core,
- said branches are separated by said openings,
- the branches are connected by an ring at the level of the free end,
- the branches are integral one in relation to the other,
- the protrusions of the core are arranged in longitudinal rows parallel to the principal axis,
- the protrusions of the core are arranged in rows that wind helically around the core,
- the protrusions of the at least one movable element are arranged between the openings.
- the protrusions of the at least one movable element are arranged in longitudinal rows parallel to the principal axis,
- the longitudinal rows of protrusions of the core are angularly alternated with the longitudinal rows of protrusions of the at least one movable element,
- an angular distribution of the protrusions of the core and an angular distribution of the protrusions of the at least one movable element are configured to leave empty areas of protrusions between the protrusions of one of the branches and the protrusions of the core passing through the adjacent opening,
- said at least one movable element moves with an angular deflection with respect to the core,
- the angular deflection is between −30° and +30°, or between −10° and +10°, or preferably between −2.5° and +2.5°,
- said at least one movable element comprising at least three longitudinal openings each extending along the principal direction so as to form at least three longitudinal rows of protrusions alternating with at least three longitudinal rows of protrusions of the core, said movable element has an elongated ogive shape along a direction substantially coaxial with the principal direction, the applicator is a monolithic piece, the applicator is a piece obtained without assembly, the applicator is a piece obtained by additive manufacturing.

The invention also relates to an applicator assembly for cosmetic product, comprising:

a container comprising a body forming a reservoir intended to contain the cosmetic product, and an applicator of the cosmetic product as described above, adapted to be attached to the container, so that the applicator is housed inside the reservoir.

Advantageously, the at least one movable element has a cross-section at the level of the free end of smaller diameter than an internal diameter of a wiper attached to the interior of the container, The invention finally relates to a method for producing an applicator for cosmetic product, in particular mascara, as described above.

The method comprises:

a step of elaborating a digital model of the applicator;

a step of producing the applicator by means of the digital model.

BRIEF DESCRIPTION OF FIGURES

Further characteristics and advantages of the invention will become apparent from the following detailed description, for the understanding of which reference is made to the attached drawings in which:

FIG. 1 is a cross-sectional view of an example of applicator assembly according to the invention;

FIG. 2 is a perspective view of an applicator according to a first embodiment of the invention;

FIG. 3 is a perspective view of the applicator of FIG. 2 showing the movement of a movable element relative to a core;

FIG. 4 is a cross-sectional perspective view of the applicator of FIG. 2;

FIG. 5 is a longitudinal cross-sectional view of the applicator of FIG. 2;

FIG. 6 is a cross-sectional view of the applicator of FIG. 2;

FIG. 7 is a longitudinal cross-sectional view of an applicator according to a second embodiment of the invention.

DETAILED DESCRIPTION OF THE INVENTION

As illustrated in FIG. 1, the invention relates to an applicator 1 for cosmetic product, in particular for mascara, comprising a core 2 extending along a direction of longitudinal extension, called principal direction and marked X in FIG. 1.

The core 2 has a proximal end 2*b* adapted to be attached to a rod 3 of the applicator 1 by a sleeve 4 extending the core 2, and a free end, also called distal end 2*a*, opposite the proximal end 2*b* along the principal direction X.

According to the invention, the applicator 1 further comprises at least one movable element 5, 5A, 5B extending along all or part of a length of the core 2 from a first end 5*a*, 5*a*A, 5*a*B attached to the core 2 towards a second end 5*b*, 5*b*A, 5*b*B free to move relative to the core 2. The second end 5*b*, 5*b*A, 5*b*B is opposite the first end 5*a*, 5*a*A, 5*a*B.

The applicator 1 further comprises a plurality of protrusions 7.1 integral with the core 2 and a plurality of protrusions 7.2, 7.2*a*, 7.2B integral with the movable element 5, 5A, 5B.

Advantageously, the core 2, the movable element 5, 5A, 5B and the protrusions 7.1, 7.2, 7.2*a*, 7.2B are thus made in one piece. The sleeve 4 has no protrusions.

Advantageously, said at least one movable element 5, 5A, 5B moves according to an angular deflection with respect to the core 2.

Preferably, the angular deflection is between −30° and +30°, or even between −10° and +10°, or preferably between −2.5° and +2.5°.

In the embodiment shown in FIGS. 1 to 6, the movable element 5 comprises three branches 9 extending in the direction of extension X of the core 2 from the first end 5*a* attached at the level of the distal end 2*a* of the core 2 towards the second end 5*b* connected to an ring 11 forming the end that is free to move relative to the core 2 of the movable element 5.

The ring 11 surrounds the core so that the core passes through it. Advantageously, the ring 11 is circular. The ring has an internal surface 11*i* directed towards the core 2 and an external surface 11*e* directed towards the outside.

The branches 9 extend along the entire length of the core 2 from the distal end 2*a* of the latter to which they are attached towards its proximal end 2*b* where they are free to move relative to the core 2.

The branches 9 are evenly angularly distributed around the core 2.

Preferably, the branches are evenly angularly distributed around the ring 11.

In the embodiment shown in FIGS. 1 to 6, the three branches are thus evenly spaced around the principal direction X with an angular spacing substantially equal to 120° angle.

Advantageously, the movable element 5 can thus move with an angular deflection relative to the core 2 in directions transverse to the principal direction.

Advantageously, the ring 11 allows to link the branches 9 together so as to form an integral assembly (the movable element 5), in which a movement of one area (one of the branches 9, for example) leads to the movement of another area (another of the branches 9, for example). In other words, the ring 11 allows the movement of one of the branches 9 to be made dependent on the movement of one other branch or all of the other branches 9. The branches 9 remain integral with each other by the ring 11. The angular deflection with respect to the core 2 is induced, for example, during the application of the cosmetic product, by the resistance between the cosmetic product and the surface to be made up or during the exit and/or the entry of a container 13 containing the cosmetic product.

Advantageously, the ring is optimally sized to allow the angular movement of the movable element 5 and to work with a neck or an opening orifice 14 of the container 13.

Advantageously, the branches 9 are connected to the core 2 by only one of their ends.

In the embodiment illustrated in FIGS. 1 to 6, the movable element 5 is thus free of any contact with the core 2 except for one end, here the distal end 5*b*.

The three branches 9 are separated by three longitudinal openings 15 which are elongated along the direction of extension X of the core 2 and form a wall around the core 2.

Advantageously, the openings 15 are evenly angularly distributed around the core 2.

In the embodiment shown in FIGS. 1 to 6, the three openings 15 are thus evenly spaced around the principal direction X with an angular spacing substantially equal to 120° angle.

The movable element 5 thus has an elongated ogive shape along a direction substantially coaxial to the principal direction X and envelops the core 2 over its entire length.

The protrusions 7.1 of the core 2 protrude through the openings 15 and each of the branches 9 also comprises protrusions 7.2 so that longitudinal rows of protrusions 7.2 of the movable element 5 alternate with longitudinal rows of protrusions 7.1 of the core 2. The applicator 1 thus comprises movable protrusions 7.2 arranged on the branches 9 of the movable element 5 and stationary protrusions 7.1 arranged on the core 2.

The presence of the movable element 5 allows for an applicator 1 with a large external envelope E, but the central core 2 of which has a small diameter which improves the flexibility and thus the softness.

The envelope E is formed by free ends 72 of the protrusions 7.1, 7.2 arranged on the core and the movable element 5.

The envelope E has a generally circular cross-section.

The fact that one end 5*a*, 5*b* of the movable element 5 is free to move with respect to the core 2 allows a homogeneous movement along the entire length of the movable element 5 when a pressure is exerted, which leads to a better distribution and/or a better expulsion of the cosmetic product along the core 2. The lashes can be enveloped with a maximum of cosmetic product which increases the volume effect.

The movable element 5 allowing a better homogeneity of the cosmetic product along the core 2, it is then possible, in an advantageous way, to reduce the length of the protrusions 7.1, 7.2 so as to favor the combing.

The movement of the movable element 5 thus advantageously allows the length of the portion of the protrusions 7.1 emerging from the opening 15 to be varied. Thus, with the same applicator, depending on the position of the movable element 5 with respect to the core 2, it is possible to have the impression of using an applicator with long protrusion (advantageous for the loading with cosmetic product) or short protrusions (advantageous for the combing of the lashes).

Apart from one end of the movable element 5, the remainder is located radially at a distance d from said core 2 so as to form a reservoir volume V.

In other words, it is possible to store the cosmetic product in the space radially between the movable element 5 and the core 2, i.e. between an internal surface 5*i* of the movable element 5 and an external surface 2*e* of the core 2.

The distance d may thus vary, in particular decrease, when a pressure is applied to the movable element 5, as shown in FIG. 3. This radial movement causes the expulsion of the cosmetic product stored in the reservoir volume V.

Advantageously, the openings 15 can also serve as a reservoir for the cosmetic product.

Again, the movement of the movable element 5 allows to make the stored cosmetic product more or less available.

When the movable element 5 is close to the core 2, the cosmetic product is easily available and can be returned to the lashes. Conversely, when the movable element 5 is away from the core 2, the cosmetic product is less available and the protrusions 7.1 of the core 2 are then used, for example, for combing the lashes. In the embodiment shown in FIGS. 1 to 6, the protrusions 7.1, 7.2 project from the core 2 and the movable element 5, in particular from the external surfaces of the branches 9, in a direction substantially normal to the principal direction X, called radial direction.

By "the protrusions 7.1, 7.2 project from the core 2 and the movable element 5 in a direction substantially normal to the principal direction X" is meant protrusions 7.1, 7.2 which project in a plane comprising the principal direction X and a radial direction of the direction X. In other words, the protrusions 7.1, 7.2 may be inclined, in this plane, towards the proximal and/or distal end, without leaving the scope of the invention.

In other embodiments not shown, the protrusions 7.1, 7.2 may have an inclination. They may, for example, project from the core 2 at an angle to the principal direction X other than 90°. In other words, the protrusions 7.1, 7.2 may be inclined towards the distal end 2*a* of the core 2 or inclined towards the proximal end 2*b* of the core 2. Any other inclination can also be considered. The protrusions 7.1, 7.2 may also have a different inclination to each other.

The protrusions 7.1, 7.2 extend from an end 71 integral with the core 2 or the movable element 5 towards the free end 72 in an elongation direction so as to define a length.

By "length" of the protrusions 7.1, 7.2 is meant the length measured between the radial periphery of the core 2 or the movable element 5 and the free distal end 72 of the protrusion 7.1, 7.2. In other words, "length" of the protrusions 7.1, 7.2 means their radial extension measured from the base of the protrusion 7.1, 7.2, in projection on a plane orthogonal to the principal direction X.

In the embodiment shown, the protrusions 7.1 projecting from the core 2 and the protrusions 7.2 projecting from the branches 9 of the movable element 5 have different lengths so that the distance between the center of the core 2 and the free end 72 of the protrusions 7.1, 7.2 comprised in a same plane transverse to the principal axis X is substantially identical.

On the other hand, the distance between the center of the core 2 and the free end 72 of the protrusions 7.1, 7.2 decreases towards the proximal 1*b* and distal 1*a* ends of the applicator 1 so as to form an ogive-shaped envelope E. The envelope E has a maximum diameter DE at the level of the center of the length of the core 2. In particular, the ogive-shaped envelope E facilitates the insertion of the applicator 1 through the neck or the opening orifice 14 of the container 13 containing the cosmetic product and the application of the cosmetic product at the level of the internal corner of the eye.

In other embodiments not shown, the distance between the center of the core 2 and the free end 72 of the protrusions 7.1, 7.2 may vary so as, for example, to form a substantially cylindrical or original shaped envelope having convex and/or concave areas.

In the embodiment shown in FIGS. 1 to 6, the protrusions 7.1, 7.2 have a quadrilateral cross-section, in particular a square cross-section, of identical size and shape over their entire length. It is also conceivable in an embodiment not shown that the protrusions 7.1, 7.2 have a cross-section whose dimension is greater in the vicinity of the end 71 than in the vicinity of the free end 72 of the protrusion 7.1, 7.2. In other words, the cross-section of the protrusion 7.1, 7.2 has a dimension that decreases from the end 71 towards the free end 72.

The core 2 may be solid or hollow without leaving the scope of the invention.

The core 2 has a circular cross-section with respect to the longitudinal direction X which is circular.

In embodiments not shown, the core 2 may also have a cross-section other than circular, without leaving the scope of the invention. The cross-section can thus be polygonal, such as triangular, or shaped like a quadrilateral, or cross-shaped, star-shaped or oblong.

The core 2 preferably has a substantially constant cross-section from its proximal end 2*b* to its distal end 2*a*, at least up to a flared part which may optionally be present at the level of the distal end 2*a* of the core 2.

In the embodiment shown in FIGS. 1 to 6, the protrusions 7.1, 7.2 projecting from the core 2 and from the movable element 5 are arranged in three longitudinal rows R1 of protrusions 7.1 coming from the core 2 and in three longitudinal rows R2 of protrusions 7.2 coming from the movable element 5.

Each of the rows R1, R2 is formed by five lines L1, L2 of protrusions 7.1, 7.2 parallel to the principal axis X arranged so that the protrusions 7.1, 7.2 form two lines which intersect at the level of a common protrusion.

It is also possible, in other embodiments not shown, for each of the rows to be a single line of protrusions 7.1, 7.2 parallel to the principal direction X or inclined with respect to the principal direction X, or for them to wind helically around the core or any other possible arrangement.

The helical winding may be such that the angular offset is between 2 and 10°, preferably 5°, so that when viewed from the distal end, the protrusions appear to form a solid disc.

As further possible arrangements, the protrusions may for example be arranged so as to form a zigzag or an undulation, i.e. be arranged on either side of the principal axis X so as to form opposite peaks, or in other words so as to form alternately projecting and retracting angles.

In other embodiments not shown, the protrusions 7.1, 7.2 projecting from the core 2 and the two branches 9 may be arranged randomly without forming longitudinal rows.

In a second embodiment illustrated in FIG. 7, the applicator 1 comprises two movable elements 5A, 5B.

Each of the movable elements 5A, 5B extends along a part of the length of the core 2 from a first end 5*a*A, 5*a*B attached to the core 2 towards a second end 5*b*A, 5*b*B free to move relative to the core 2.

The first movable element, called the distal movable element 5A, is connected to the core 2 by a first end 5*a*A attached at the level of the distal end 2*a* of the core 2. The movable element 5A extends towards the proximal end 2*b* of the core 2 to the second end 5*b*A which is free to move relative to the core 2 and is located approximately in the center of the length of the core 2.

The second movable element, called proximal movable element 5B, is connected to the core 2 by a first end 5*a*B attached at the level of the proximal end 2*b* of the core 2. The movable element 5B extends towards the distal end 2*a* of the core 2 to the second end 5*b*B which is free to move relative to the core 2 and is located approximately in the center of the length of the core 2.

In other words, each of the movable elements 5A, 5B faces each other symmetrically with respect to a plane P orthogonal to the principal direction X. The two movable elements 5A, 5B are images of each other in a mirror. The two movable elements 5A, 5B thus form an egg-shaped structure like a cage around the core 2. Each of the movable elements 5A, 5B is movable relative to the core 2 independently of each other. Thus, it is possible for only one of the two movable elements 5A, 5B to have an angular movement relative to the core 2, while the other of the two movable elements 5B, 5A has no movement. This offers an additional variety of make-up effects.

This embodiment differs from the first in that there are two movable elements 5A, 5B which extend over only a part of the core 2.

Each of the movable elements 5A, 5B is substantially similar to the movable element 5 previously described in the first embodiment.

Therefore, what is described above for the first embodiment also applies to this second embodiment, adapting to the presence of two movable elements 5A, 5B.

The reference signs of the first embodiment have been adopted. They are followed by the letter "A" for the reference signs of the distal movable element 5A and followed by the letter "B" for the reference signs of the proximal movable element 5B.

In another embodiment not shown, the two movable elements may be different from each other, in particular they may not be symmetrical. For example, one of the movable elements may extend over a greater length of the core than the length over which the other movable element extends.

Advantageously, the applicator 1 is a single monolithic piece obtained without assembly. In other words, the applicator 1 is not obtained by assembly.

Assembly is understood here as the fact of putting together, joining at least two isolated elements, but does not exclude the possibility of several steps.

It should also be noted that the applicator 1 advantageously forms a brush.

Preferably, the applicator 1 described above is obtained by an additive producing method.

Additive producing method means a producing method by adding material, generally computer assisted. Such a producing method is also called three-dimensional printing or 3D printing.

Advantageously, the use of three-dimensional printing can allow to produce in a single step an applicator 1 in a single piece and in continuity of material comprising a core 2 and at least one movable element 5, 5A, 5B, one end of which is attached to the core 2 and the other of which is free to move with respect to the core 2, each having protrusions 7.1, 7.2, 7.2A, 7.2B. Such an applicator 1 could be very complex or even impossible to obtain, in particular in one piece, by a conventional injection molding method. It is thus possible to produce the applicator 1 directly and in a single producing operation. In addition, this technique eliminates the need for complex molds.

Alternatively, the three-dimensional printing may be used to form the core 2 with the sleeve 4 and/or the rod 3.

Various additive manufacturing technologies known to the person skilled in the art can be used. In particular, this may include:

- fused deposition modeling (FDM),
- selective laser melting (SLM),
- selective laser sintering (SLS),
- electron beam melting (EBM),
- stereolithography or photopolymerization (SLA for Stereolithography Apparatus), or
- laminated object manufacturing (LOM).

Preferably, these are sintering and/or stereolithography technologies.

The invention further relates to a method for producing an applicator 1 as described above. The method comprises:

- a step of elaborating a digital model of the applicator 1;
- a step of producing the applicator 1 by means of the digital model.

The digital model is a computer file that corresponds to a virtual model of the applicator 1. To obtain this, the applicator 1 is first modeled so as to obtain a CAO model which is then converted into a suitable format such as an .STL file. The file is then processed on an additive manufacturing machine. When the digital model is read, it is divided into a number of layers depending on the desired accuracy. Preferably, the layers correspond to a cross-section of the applicator 1, i.e. a section of the applicator 1 taken in a plane perpendicular to the principal direction X.

The suitable materials for producing the applicator 1 by three-dimensional printing are polyamides, light-sensitive resins, polylactic acid (PLA), acrylonitrile butadiene styrene (ABS).

The invention also relates to an applicator assembly 16 for cosmetic product, comprising the container 13 comprising a body 17 forming a reservoir intended to contain the cosmetic product (not shown), and an applicator 1, as previously described, adapted to be attached to the container 13, such that the applicator 1 is housed inside the reservoir. The applicator 1 is attached, for example, to a proximal end of the rod 3, which is itself attached to a cap 18 advantageously screwed to the container 13.

Advantageously, the container 13 comprises a wiper 19 attached inside the container 13, in particular in the neck or the opening orifice 14 of the container 13.

Preferably, the at least one movable element 5, 5A, 5B has a cross-section at the level of the free end with a diameter smaller than an internal diameter of the wiper 19. The applicator 1 can thus enter and/or exit the container 13 without the at least one movable element 5, 5A, 5B being damaged as it passes through the wiper 19.

Advantageously, the envelope E of the applicator 1 formed by the free ends 72 of the protrusions 7.1, 7.2, 7.2A, 7.2B has a generally circular cross-section whose maximum diameter is substantially identical to the inner diameter of the wiper 19.

Advantageously, the ring 11 is optimally sized to allow the angular movement of the movable element 5, 5A, 5B and to work with the wiper 19.

Thus, the passage of the applicator 1 through the wiper 19 allows to remove the surplus of cosmetic product but also to homogenize the distribution of the cosmetic product along the core 2 because of the freedom of movement of the movable element 5, 5A, 5B, in particular the angular deflection.

Advantageously, the applicator assembly 16 may be obtained in whole or in part by three-dimensional printing.

The invention claimed is:

1. An applicator for cosmetic product, comprising:

a core extending in a direction of longitudinal extension, ("principal direction") and comprising a proximal end, the proximal end being adapted to attached to a rod of the applicator by a sleeve extending the core, and at least one movable element extending along all or part of a length of the core from a first end attached to the core towards a second end that is free to move in relation to the core, said core and/or the at least one movable element comprising a plurality of projecting protrusions, wherein, the at least one movable element comprises branches extending along the direction of longitudinal extension of the core from the first end to the second end of the at least one movable element, the branches being connected by a ring at the second end that is free to move in relation to the core, wherein the ring is not connected to the core, the sleeve and the rod.

2. The applicator according to claim 1, wherein the first end is attached at the level of a distal end of the core.

3. The applicator according to claim 1, wherein the at least one movable element comprises a wall having at least one opening through which protrusions of the core project.

4. The applicator according to claim 3, wherein said branches are separated by the at least one opening.

5. The applicator according to claim 1 wherein said at least one movable element moves with an angular deflection with respect to the core.

6. The applicator according to claim 1 wherein said at least one movable element comprises at least three longitudinal openings each extending along the principal direction so as to form at least three longitudinal rows of protrusions alternating with at least three longitudinal rows of protrusions of the core.

7. The applicator according to claim 6, wherein said movable element has an elongated ogive shape along a direction substantially coaxial to the principal direction.

8. The applicator according to claim 1, wherein the applicator is a monolithic piece obtained without assembly and by additive manufacturing.

9. An applicator assembly for cosmetic product, comprising:

a container comprising a body forming a reservoir intended to contain the cosmetic product, and an applicator of the cosmetic product adapted to be attached to the container, so that the applicator is housed inside the reservoir, the applicator comprising:

a core extending in a direction of longitudinal extension ("principal direction"), and comprising a proximal end, the proximal end being adapted to attached to a rod of the applicator by a sleeve extending the core, and at least one movable element extending along all or part of a length of the core from a first end attached to the core towards a second end that is free to move in relation to the core, said core and/or the at least one movable element comprising a plurality of projecting protrusions, wherein, the at least one movable element comprises branches extending along the direction of longitudinal extension of the core from the first end to the second end of the at least one movable element, the branches being connected by a ring at the second end that is free to move in relation to the core, wherein the ring is not connected to the core, the sleeve and the rod.

10. A method for producing an applicator for cosmetic product, the applicator comprising a core extending in a direction of longitudinal extension ("principal direction") and comprising a proximal end, the proximal end being adapted to attached to a rod of the applicator by a sleeve extending the core, and at least one movable element extending along all or part of a length of the core from a first end attached to the core towards a second end that is free to move in relation to the core, said core and/or the at least one movable element comprising a plurality of projecting protrusions, wherein, the at least one movable element comprises branches extending along the direction of longitudinal extension of the core from the first end to the second end of the at least one movable element, the branches being connected by a ring at the second end that is free to move in relation to the core, wherein the ring is not connected to the core, the sleeve and the rod, the method comprising:

elaborating a digital model of the applicator; and producing the applicator by means of the digital model.

* * * * *